United States Patent [19]

Becker

[11] 4,275,471

[45] Jun. 30, 1981

[54] HYDRAULICALLY OPERATED FLUSH VALVE FOR TOILET FLUSH TANKS AND SIMILAR DEVICES

[76] Inventor: Howard W. Becker, 804 Imperial Way SW., Calgary, Alberta, Canada, T2S 1N7

[21] Appl. No.: 925,643

[22] Filed: Jul. 17, 1978

[51] Int. Cl.[3] ..... E03D 1/34; E03D 1/14; E03D 3/12

[52] U.S. Cl. ..... 4/387; 4/324; 4/361; 4/388; 4/403; 4/407; 4/408

[58] Field of Search ..... 4/407, 405, 410, 412, 4/411, 413, 404, 403, 388, 398, 395, 360, 387

[56] References Cited

U.S. PATENT DOCUMENTS

| | | | |
|---|---|---|---|
| 399,690 | 3/1889 | Newell | 4/388 |
| 1,568,346 | 1/1926 | Ryan | 4/388 |
| 2,632,180 | 3/1953 | Pegler | 4/407 |
| 2,644,952 | 7/1953 | Boyd | 4/407 |
| 3,817,279 | 6/1974 | Larson | 4/360 |
| 3,958,281 | 5/1976 | Remmel | 4/395 |
| 3,987,501 | 10/1976 | Anderson | 4/407 X |
| 3,994,029 | 11/1976 | Badders | 4/407 X |

*Primary Examiner*—Henry K. Artis

[57] ABSTRACT

This invention comprises an improved hydraulically operated flush valve for toilet flush tanks and similar devices. Its main components are a cylinder and piston assembly positioned with its longitudinal axis directly above and vertically aligned with the vertical axis of the outlet or flush tube of the flush tank. The moveable piston within the fixed cylinder acts as the moving and sealing element of the flush valve. By means of an inner valve connected to the flush tank operating lever hydraulic force is caused to lift the piston thereby opening the flush valve. There is no direct mechanical connection between the operating arm and the flush valve, and there are no chains or hinges. There is a positive permanent flush valve alignment and a minimum of friction. In addition, the amount of water used per flushing action can be regulated to prevent water and energy wastage.

3 Claims, 7 Drawing Figures

OPEN

CLOSED

HYDRAULICALLY OPERATED FLUSH VALVE FOR TOILET FLUSH TANKS AND SIMILAR DEVICES

This invention comprises an improved hydraulically operated flush valve for toilet flush tanks and similar devices.

The normal flush valves utilized in the operation of flush tanks have certain drawbacks which frequently prevent proper valve closure. This results in water wastage and irritating noise, and may prevent the refill of the flush tank for subsequent use. The flush valves in general use consist of two components, the stationary seat and the moving element of the valve. The valve seat is formed, usually as a bevelled section, by the upper portion of the flush tube which drains the water from the flush tank into the toilet bowl. The moving component of the valve generally consists of a flexible hollow ball or an inverted cone-shaped element usually open at the bottom and so designed as to fit onto the valve seat when closed to prevent water from discharging into the toilet bowl. When the moving element is in the raised or open position the air in the hollow portion (or a float-type component) provides buoyancy. This keeps the moving element in the open position until the water has drained from the flush tank, at which time buoyancy is no longer provided to the moving element which then drops into the closed position. The moving element is usually guided into the proper seating position by a vertical sliding rod arrangement, or by a hinged system permitting an angular rotation throughout the opening and closing movements. The moving element is opened by actuation of the flush tank operating handle which raises the element by means of either a chain type device or a guided sliding rod system.

The chief problems in the use of these devices result from the misalignment or the sticking, binding or kinking of the moving parts, causing improper closure of the valve.

In addition there is no provision for adjustment of the amount of water utilized in each flushing operation, so that normally more water is released than necessary to effect complete flushing of the toilet bowl and a considerable amount of water and energy are wasted. Also, sufficient force must be exerted in the operation of the flush valve to directly overcome the hydraulic pressure on the moveable element, and this force causes wear and frequent replacement of the mechanically connected moving parts.

The present invention is designed to overcome the above disadvantages by utilizing a hydraulically operated piston and cylinder assembly positioned directly above the flush tube and actuated by the movement of an inner valve, within the assembly, connected to the flush tank operating lever. The piston, with a sealing element attached to it, comprises the moving component of the flush valve. There is no direct mechanical connection between the operating lever and the moving element of the flush valve, and a much reduced operating force is required. The vertical position of the cylinder assembly can be adjusted so as to control the amount of water released per flush valve operation, and the amount of water released may be further controlled by small variations in the length of time during which the operating lever is held in the flushing position.

A specific embodiment of the invention is illustrated in the accompanying drawings in which.

Figure 6:
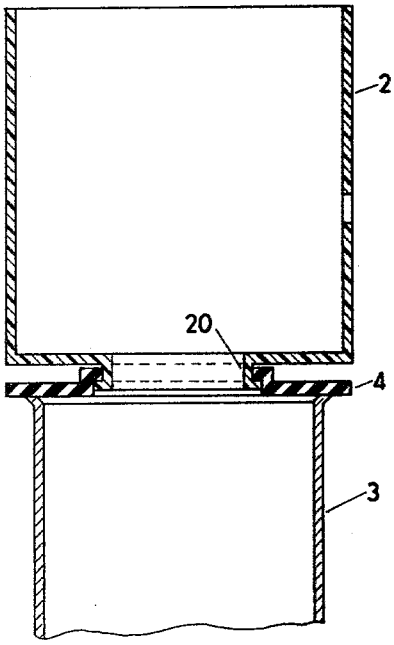
FIG. 6 illustrates a suitable method of fastening the sealing element onto the piston end, so that it is readily replaceable when worn.

Referring to the drawings in detail, wherein like numbers indicate like parts, the stationary cylinder 1 is attached by a clamp 10 or other mounting device to the flush tank overflow tube 17, with its open end facing downward, and is positioned directly above the flush tube 3 with its vertical axis coincident with the vertical axis of the flush tube. The upper end of the flush tube is normally shaped to perform the function of the fixed seat of the flush valve. The closed upper end of the cylinder 1 is fitted with a tube 8 opening into the cylinder and extending above the level of the water in the flush tank when filled. This tube 8 acts as a conduit for the flow of air into and out of the interior of the cylinder and piston assembly, thus permitting the free flow of water to and from the interior as required by the operation of the inner valve 6 and the movement of piston 2. The tube 8 also acts as a guide for rod (or tube) 7 which raises the inner valve 6 as required. The piston 2 moves vertically within cylinder 1. The upper end of the piston is open, while the lower end is closed except for a central circular opening 5. This opening 5 permits the flow of water into the flush tube when inner valve 6 is raised from seat 5A fitting around the perimeter of opening 5. On the bottom side of the downward end of the piston 2 is fastened the sealing element 4 which fits onto the flush tube valve seat when in the closed (down) position. Sealing element 4 may be flat, bevelled, tapered, conical or may have a cylindrical extension on its lower side. Sealing element 4 is designed for easy removal and replacement when necessary due to wear. FIG. 6 illustrates a suitable method of attachment of the sealing element 4 to the bottom of piston 2. Also piston 2 is provided with a small opening in its cylindrical wall (the side wall), approximately half way between the top and bottom of the side wall, the purpose of which is described below.

The operation of the flush valve is described as follows. In the closed position of the flush valve, piston 2 and sealing element 4 are in the down position and are resting on the flush tube valve seat. Thus there is no flow of water through the valve and the hydraulic force on the circular area of the upper side of the closed end of piston 2 is greater than the hydraulic force on the lower annular portion of the outside of the piston end and thus the valve remains tightly closed. When the operating lever of the flush tank raises inner valve 6 (by means of an adapter described later) water within the piston is discharged into the flush tube and is replaced by air entering through tube 8. Thus there is no hydraulic pressure exerted on the upper or inside end of piston 2, while the annular area of the bottom of the end of the piston is still exposed to the hydraulic force exerted by the height of water in the filled flush tank. Therefore the piston moves upward into the cylinder and sealing element 4 is raised off the flush tube valve seat. The water in the flush tank thus discharges through the flush tube, causing the flushing action in the toilet bowl.

When the water level in the flush tank recedes to a lever near the bottom of the piston 2 there is no longer sufficient hydraulic force to keep the piston in the up position and the piston with the flush valve sealing element drops onto the seat on the upper end of flush tube 3 thus closing the flush valve. When the piston is in the down position the opening 18 in the piston wall allows water, which is flowing into the flush tank via the normal flush tank inlet control valve, to enter the inside of the piston 2 and fill it along with cylinder 1 and tube 8 to a level equal to the level in the tank. Again the hydraulic force on the upper side of the bottom end of the piston 2 is greater than that on the lower annular side thereof and the piston remains in the closed position. When piston 2 is in the up position, opening 18 is sealed by the wall of cylinder 1 and is no longer exposed to the water in the flush tank, and water cannot enter into the interior of the piston and cylinder until the piston moves into the down position. Also inner valve 6 becomes closed when piston 2 is in the up position, trapping the air within the cylinder and piston. Thus the piston 2 remains in the up position (with the flush valve open) until the flush tank water level is too low to provide buoyancy, at which time the piston 2 moves into the down position and the flush valve is closed.

The vertical position of the otherwise fixed cylinder 1 can be adjusted, and the position of piston 2 in the up position can thus be adjusted. This allows control of the level of water in the flush tank at which the piston drops to the down position and closes the flush valve. Thus the amount of water released per flushing operation can be varied sufficiently to obtain maximum water saving possible without preventing effective flushing action to take place. The balance of hydraulic forces inside and outside the piston can be further altered by varying the duration of the time during which the operating lever is held in the "flush" position. This governs the amount of water released from the inside of piston 2. If the water is only partially discharged therefrom, then the weight of the piston when in the up position will be increased, and the piston will return to the down (flush valve closed) position while the level of water in the flush tank is higher than it would have been had all the water in the piston been released. In this way also the amount of water used per flush can be regulated.

Figure 1:
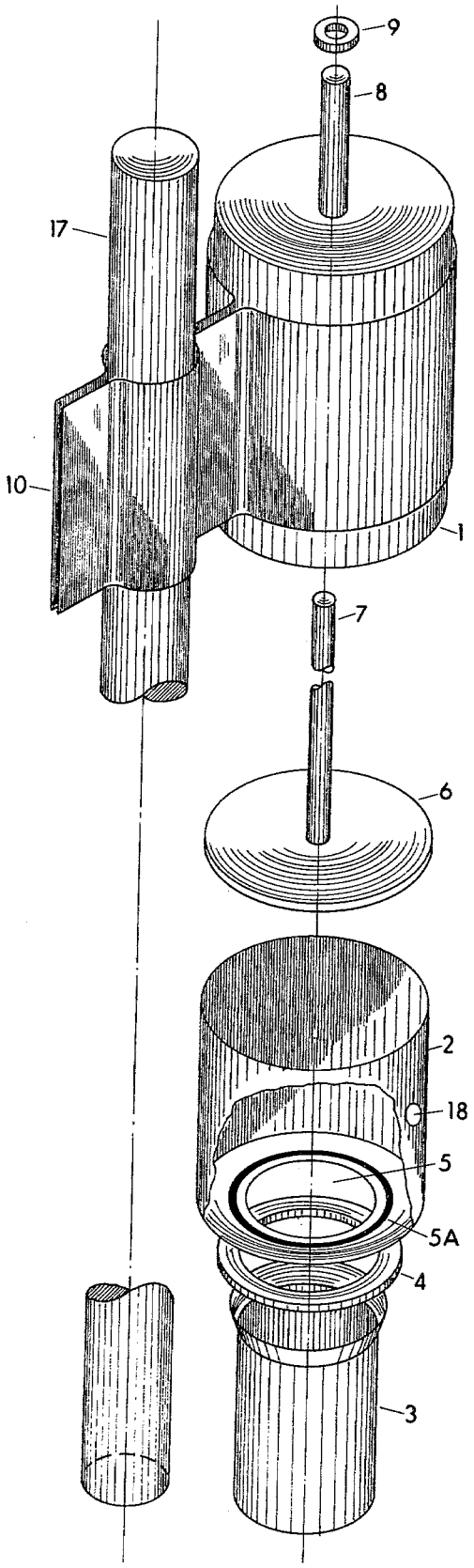
FIG. 1 is an exploded perspective view showing the individual elements of the flush valve, the flush tube, and the overflow tube.
Figure 2A:
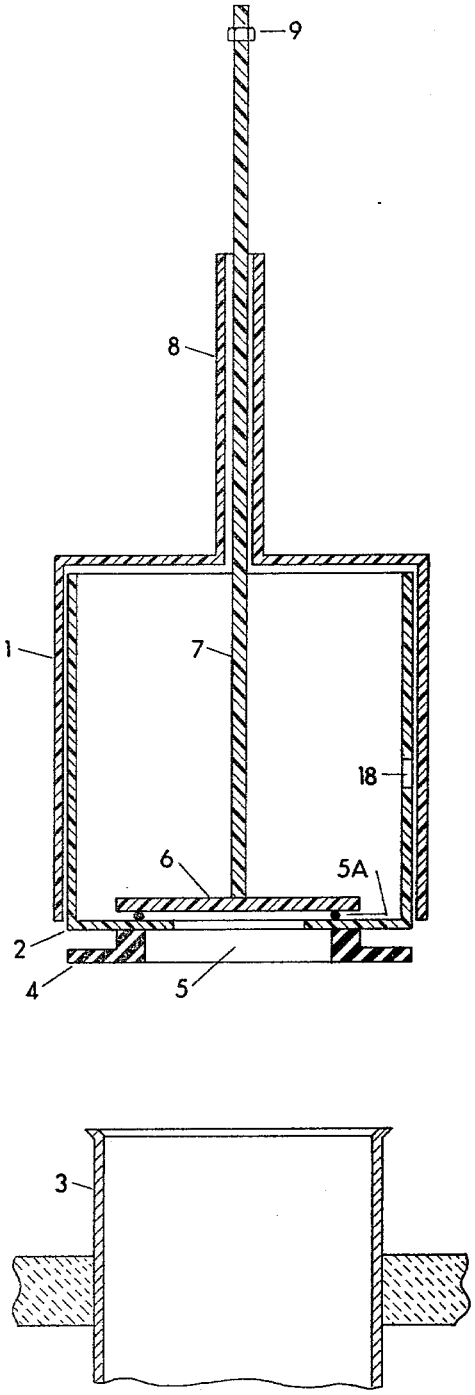
FIGS. 2A and 2B are a sectional view showing the individual elements of the flush valve and the flush tube.
Figure 2B:
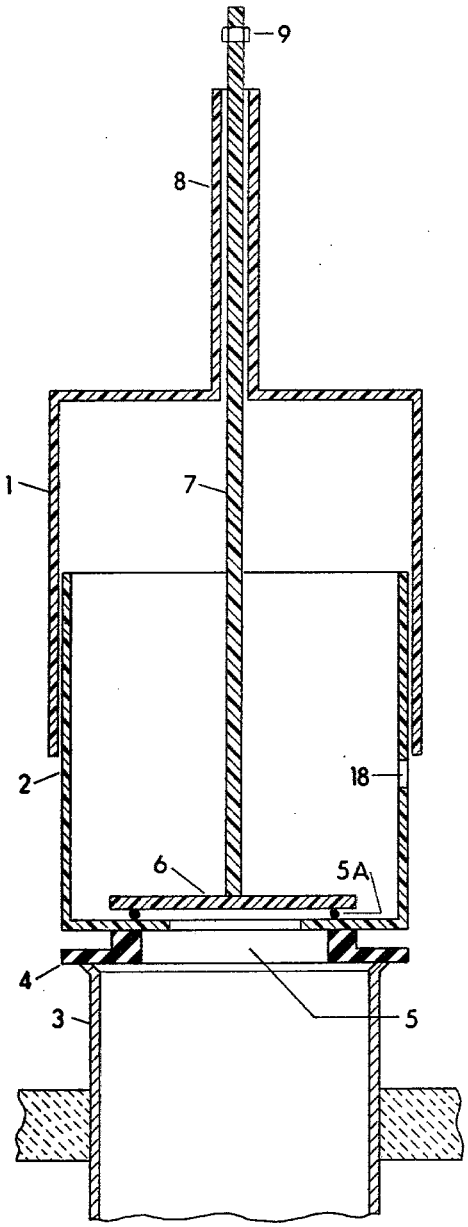
Figure 3:
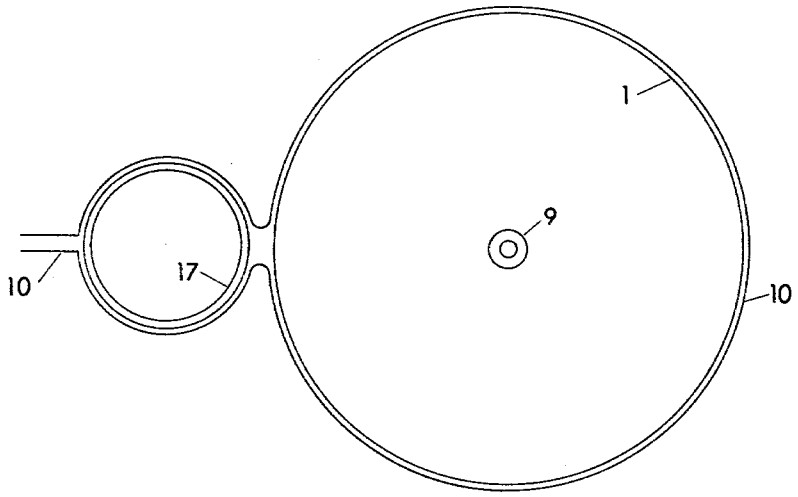
FIG. 3 is a plan view of the flush valve assembly.
Figure 4:
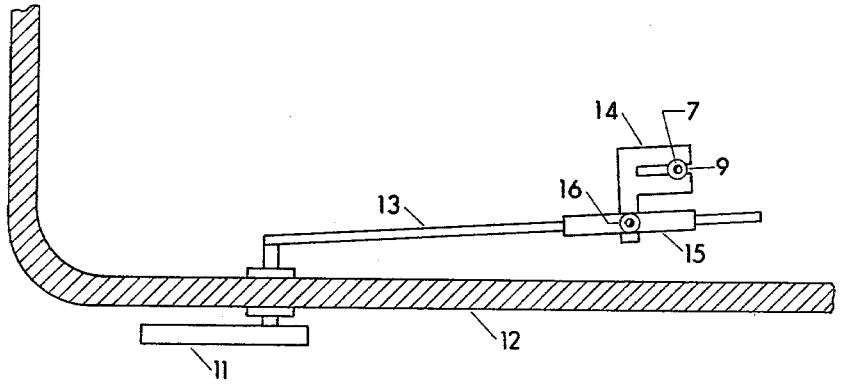
FIG. 4 is a plan view of the adjustable adapter to be fitted to the inside arm of the flush tank operating lever.
Figure 5:
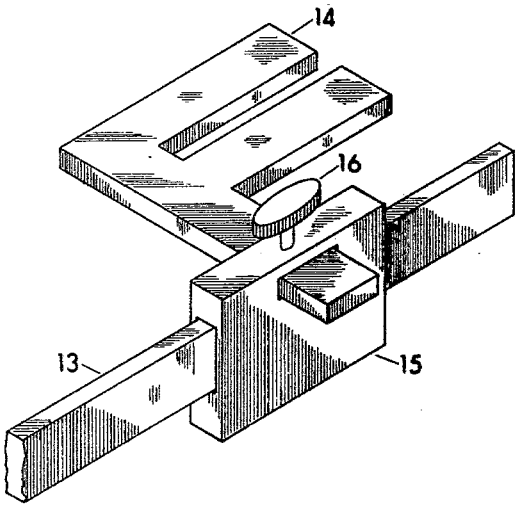
FIG. 5 is a perspective view of the adjustable adapter to be fitted to the inside arm of the flush tank operating lever.

FIGS. 4 and 5 illustrate a suitable adapter for fitting onto the inner arm 13 of the operating lever 11 of the flush tank. A loose-fitting sleeve 15 slides over arm 13. An L-shaped component 14 is slotted on one arm of the L, while the other arm is shaped to slide into an opening in the loose-fitting sleeve 15. When the positions of the sleeve 15 and the slotted arm of component 14 are in the correct position to raise bushing 9 on rod (or tube) 7 without interfering with the subsequent lowering of rod 7 through friction or binding, then set screw 16 is tightened holding both parts in the correct position. Bushing 9 is located above the slot in component 14, and the inner valve rod 7 fits loosely in the slot throughout its full travel. The operation may be described as follows: When the flush valve is in the closed position and the operating handle is in the released position, component 14 rests on the top of tube 8 and is slightly below bushing 9. When the operating lever is actuated, arm 13 is raised causing component 14 to lift bushing 9 and open valve 6. The operating lever is thus able to apply a lifting force on inner valve rod 7, but is unable to apply a downward force thereon. Other suitable designs of operating lever adapters may also be used.

Illustrated in FIG. 6 is a suitable method of attaching the flexible sealing element 4 to the bottom end of piston 2. The flexible upper neck of the sealing element stretches to fit tightly over collar 20 of piston 2 and provides a leakproof connection. The sealing element can be removed readily and replaced when worn. The annular seating face of the sealing element is sufficiently flexible to make a water tight seal on the upper end of the flush tube 3 and will allow for minor valve misalignment and a slightly irregular valve seat surface formed by the upper and of flush tube 3. FIG. 6 shows one of a number of methods of attaching the sealing element 4 to piston 2.

The embodiments of the invention in which an exclusive property or privilege is claimed are defined as follows:

1. A flush valve for flush tanks for toilets and like devices comprising a stationary cylinder fitted with a moveable piston and positioned below the filled water level of the flush tank by attachment to the usual flush tank overflow tube by means of a clamping arrangement, with the longitudinal axis of the cylinder and piston directly above and vertically aligned with the vertical axis of a flush tube located in the bottom of the flush tank; the lower end of the stationary cylinder being open and accommodating the moveable piston, while the upper end is closed and provided with a tube which is suitably smaller in diameter than the diameter of the cylinder and which opens into the cylinder and extends above the normal filled level of the water in the flush tank and communicates with the air space above the water; the piston being moveable vertically within the cylinder and having its upper end open while its lower end is closed except for a centrally located circular opening which is suitably smaller than the diameter of the interior opening of the flush tube; the bottom of the otherwise closed end of the piston being fitted with an annular resilient sealing element around and concentric with the circular opening and so sized as to fit onto the circular upper edge of the flush tube, thus becoming the sealing portion of the moveable element of the said flush valve, while the upper portion of the flush tube acts as the stationary seat of the flush valve; the upper side of the lower annular portion of the piston being fitted with an annular inner valve seat so that a moveable element comprising an inner valve can seat thereon and thus close the bottom end of the piston; the inner moveable valve element being connected to a rod (or tube) which passes through the smaller diameter tube in the upper end of the stationary cylinder and thus into the air space above the filled level of the flush tank and which can be raised by an operating lever of the flush tank; an operating lever inner arm being adapted so as to provide means of raising the inner valve rod, and being incapable of exerting a downward force thereon; the whole mechanism being such that, upon depressing an exterior handle of the operating lever, the inner arm thereof is raised causing the inner valve element to open and allowing the liquid within the interior of the cylinder and piston to discharge through the flush tube; this in turn eliminating the hydraulic force within the piston and thus allowing the hydraulic force on the annular area of the outside of the bottom of the piston not covered by the flush tube to raise the piston and the sealing element and thus open the flush valve; whereby when the piston rises, the moveable element of the inner valve rests upon its annular seat in the upper side of the piston end; whereby when the water level in the flush tank has dropped to a level near the bottom of the raised piston, there is no longer sufficient upward force to maintain the piston in the raised position, and it moves downward so that the sealing element on the bottom fits onto the flush tube valve seat, and the flush valve is closed; the flush tank thus being allowed to fill with the water from a float-actuated water fill valve, and allowing the water to flow through a small port in the side of the piston which is opened when the piston is in the down position and closed when the piston is in the up position; this in turn developing a hydraulic force on the inside bottom of the piston (with the closed inner valve) which is greater than the hydraulic force on the annular area of the outside bottom of the piston which is not covered by the flush tube, maintaining the piston in the down (valve closed) position until the next actuation of the operating lever occurs.

2. An apparatus as in claim 1, and with a replaceable flat, bevelled, tapered or conical annular sealing element attached to the bottom of the moveable piston which comprises the moving element of the flush valve.

3. An apparatus as in claims 1 or 2 with a slotted member for lifting the actuating rod of the inner valve moving element, the said member being mounted adjustably on the inner operating arm of the flush tank in such a way as to provide a lifting force on the inner valve rod without interference or binding on the rod when same returns to the lowered (inner valve closed) position.

* * * * *